US009107004B2

(12) United States Patent
Hedrick et al.

(10) Patent No.: US 9,107,004 B2
(45) Date of Patent: Aug. 11, 2015

(54) BONE CONDUCTION COMMUNICATIONS HEADSET WITH HEARING PROTECTION

(71) Applicant: Atlantic Signal, LLC, Silver Lake, KS (US)

(72) Inventors: Randall Hedrick, Topeka, KS (US); David J. Bondarenko, Topeka, KS (US)

(73) Assignee: ATLANTIC SIGNAL, LLC, Silver Lake, KS (US)

( * ) Notice: Subject to any disclaimer, the term of this patent is extended or adjusted under 35 U.S.C. 154(b) by 81 days.

(21) Appl. No.: 13/776,167

(22) Filed: Feb. 25, 2013

(65) Prior Publication Data

US 2013/0202135 A1 Aug. 8, 2013

Related U.S. Application Data

(63) Continuation-in-part of application No. 12/833,067, filed on Jul. 9, 2010, now Pat. No. 8,385,576.

(60) Provisional application No. 61/224,740, filed on Jul. 10, 2009.

(51) Int. Cl.
*H04R 25/00* (2006.01)
*H04R 1/46* (2006.01)
(Continued)

(52) U.S. Cl.
CPC ..... *H04R 1/46* (2013.01); *H04R 1/105* (2013.01); *H04R 1/1066* (2013.01); *H04R 1/1083* (2013.01); *H04R 5/0335* (2013.01); *H04R 2201/107* (2013.01); *H04R 2460/13* (2013.01)

(58) Field of Classification Search
CPC .... H04R 1/105; H04R 1/1066; H04R 1/1083; H04R 1/46; H04R 2201/107; H04R 2460/13; H04R 5/0335
USPC ..... 381/309, 326, 328, 151, 370, 374, 376, 381/380, 384; 379/430, 433.02; 455/569.1, 455/575.1, 575.2
See application file for complete search history.

(56) References Cited

U.S. PATENT DOCUMENTS 5,845,197 A * 12/1998 Hada et al. ..... 455/569.1
D424,568 S 5/2000 Gerdom
(Continued)

FOREIGN PATENT DOCUMENTS

EP 0806099 B1 8/2000
WO WO 2007/107985 A2 9/2007
WO WO 2007133055 A1 11/2007

OTHER PUBLICATIONS

Datasheet for Phonak ear piece with concha retention bow not invented by applicants.
(Continued)

*Primary Examiner* — Huyen D Le
(74) *Attorney, Agent, or Firm* — Erickson Kernell Derusseau & Kleyas, LLC

(57) ABSTRACT

A communications headset includes bone vibrating transducers supported over the temporal bones of a wearer in front of each ear and an earpiece. The earpieces, when not in use, are magnetically couplable to a transducer housing. Radio signals received by a wearer or vehicular mounted radio are processed by and distributed through a communications interface to both the transducers and the earpiece speakers. Ambient or external noises picked up by one or more microphones on each earpiece are processed to reduce ambient noises above a certain level.

18 Claims, 6 Drawing Sheets

(51) Int. Cl.
*H04R 1/10* (2006.01)
*H04R 5/033* (2006.01)

(56) References Cited

U.S. PATENT DOCUMENTS

| | | | | |
|---|---|---|---|---|
| D425,511 | S | 5/2000 | Gerdom | |
| D428,875 | S | 8/2000 | Gerdom | |
| D444,142 | S | 6/2001 | Gerdom | |
| D454,554 | S | 3/2002 | Gerdom | |
| 6,374,126 | B1 | 4/2002 | MacDonald, Jr. et al. | |
| D460,752 | S | 7/2002 | Gerdom | |
| 6,456,721 | B1 | 9/2002 | Fukuda | |
| D550,656 | S | 9/2007 | Gerdom et al. | |
| 7,436,974 | B2 * | 10/2008 | Harper | 381/374 |
| 2006/0227982 | A1 | 10/2006 | Miranda | |
| 2009/0060231 | A1 | 3/2009 | Buroojy | |
| 2009/0092269 | A1 | 4/2009 | Nielsen et al. | |

OTHER PUBLICATIONS

International Search Report and the Written Opinion of the International Searching Authority in International Application No. PCT/US/2010/041517 which claims priority from U.S. Appl. No. 12/833,067.

* cited by examiner

Fig.4.
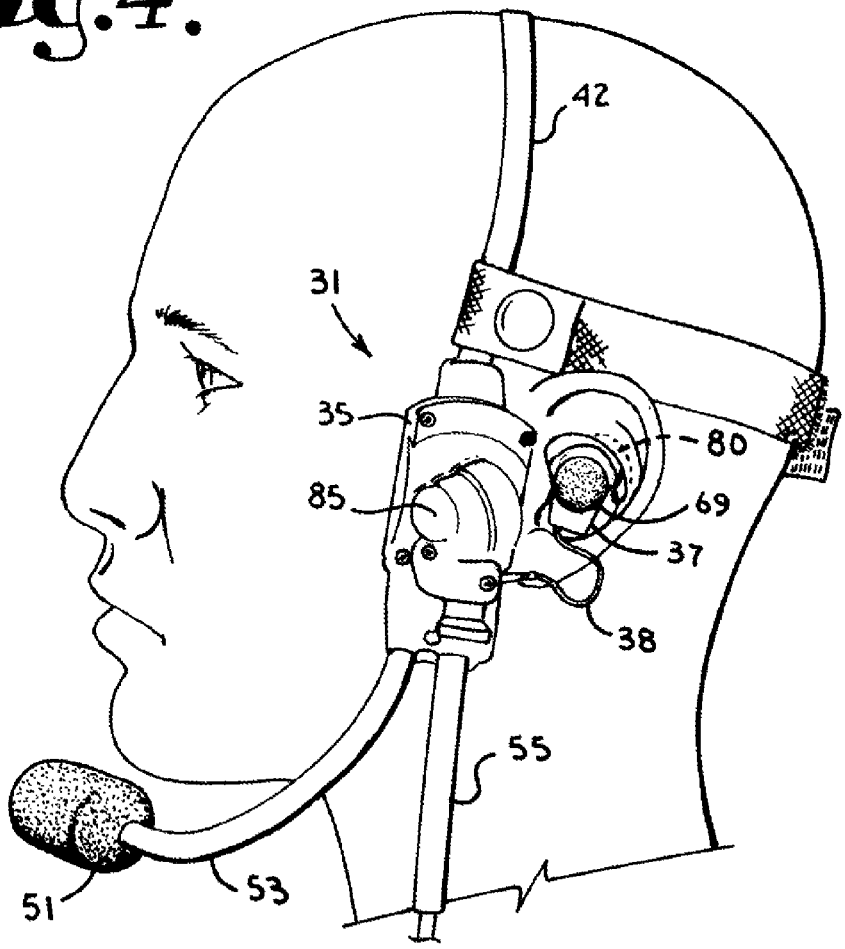
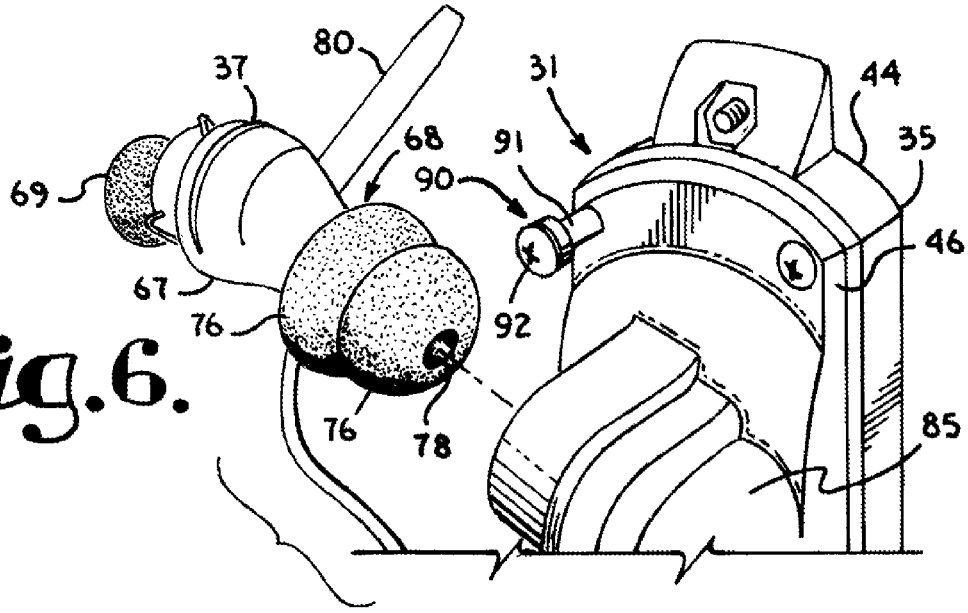
Fig.6.

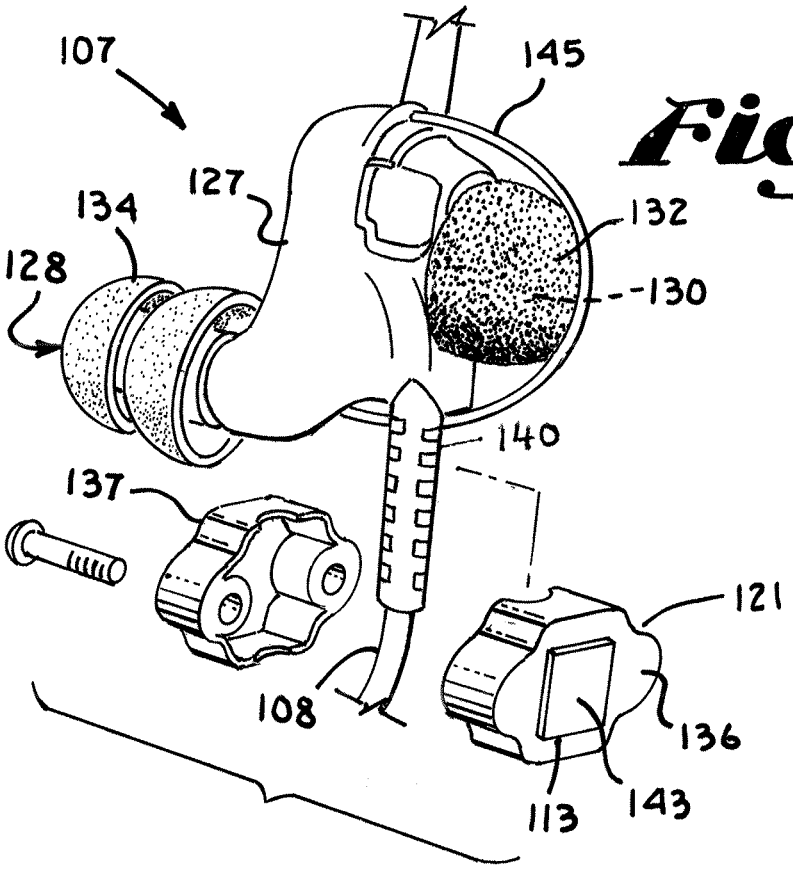
Fig. 10.
Fig. 11.
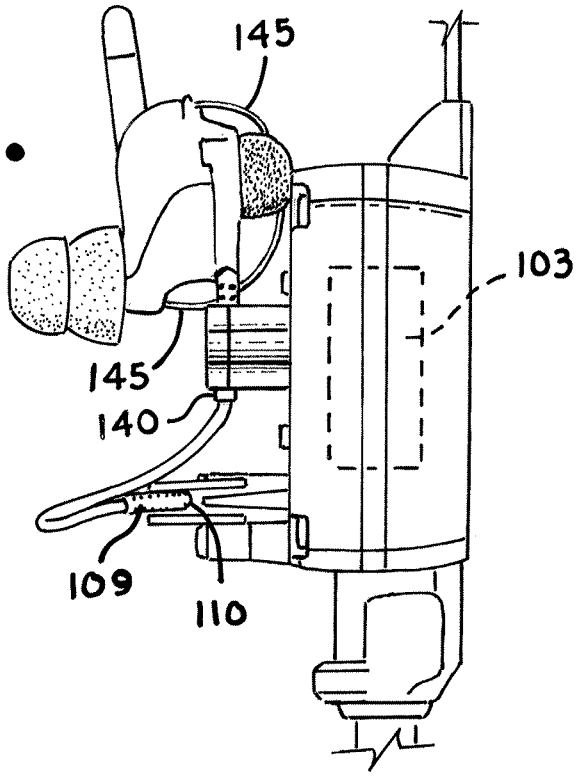

BONE CONDUCTION COMMUNICATIONS HEADSET WITH HEARING PROTECTION

CROSS-REFERENCE TO RELATED APPLICATIONS

This application is a Continuation-In-Part of application Ser. No. 12/833,067 filed Jul. 9, 2010 and also claims the benefit of Provisional Application Ser. No. 61/224,740 filed Jul. 10, 2009.

BACKGROUND OF THE INVENTION

1. Field of the Invention

The present invention relates to communications headsets.

2. Description of the Related Art

Conventional communications headsets include acoustic speakers for directing sound waves generated by a radio receiver or other circuitry into a wearer's ear canal and the auditory mechanism responsible for hearing. In the headset industry, it is also known to use bone vibrating transducers mounted in housings incorporated into a headset to transmit sound waves generated by a radio receiver through the temporal bones or other cranial bones of a wearer directly to the inner ear cochlea, allowing sounds to bypass the eardrum. See for example, U.S. Design Pat. No. D550656. Headsets incorporating bone vibrating transducers are known to be particularly useful in applications in which the wearer wants to leave the auditory canal of the ear unoccluded to hear sounds in the ambient environment. Bone vibrating transducer headsets are also advantageous in that they allow the wearer to engage and disengage various forms of hearing protection while having no negative impact on the wearer's ability to hear radio transmissions.

There remains a need for improved communications headsets for military and law enforcement tactical applications.

BRIEF DESCRIPTION OF THE DRAWINGS

FIG. 4 is a fragmentary side view of an alternative embodiment of the communications headset shown secured to the head of a wearer with an earpiece positioned in the wearer's ear.

FIG. 6 is an exploded, enlarged and fragmentary, right side perspective view of the housing of the communications headset similar to FIG. 5 showing the earpiece separated from the holster.

FIG. 10 is an enlarged, fragmentary and exploded perspective view of the earpiece and magnet mounting assembly clamped around the cord guard for the earpiece.

FIG. 11 is a fragmentary, right side elevational view of the housing as shown in FIG. 9 with the earpiece magnetically coupled thereto.

DETAILED DESCRIPTION OF THE PREFERRED EMBODIMENTS

Figure 1:
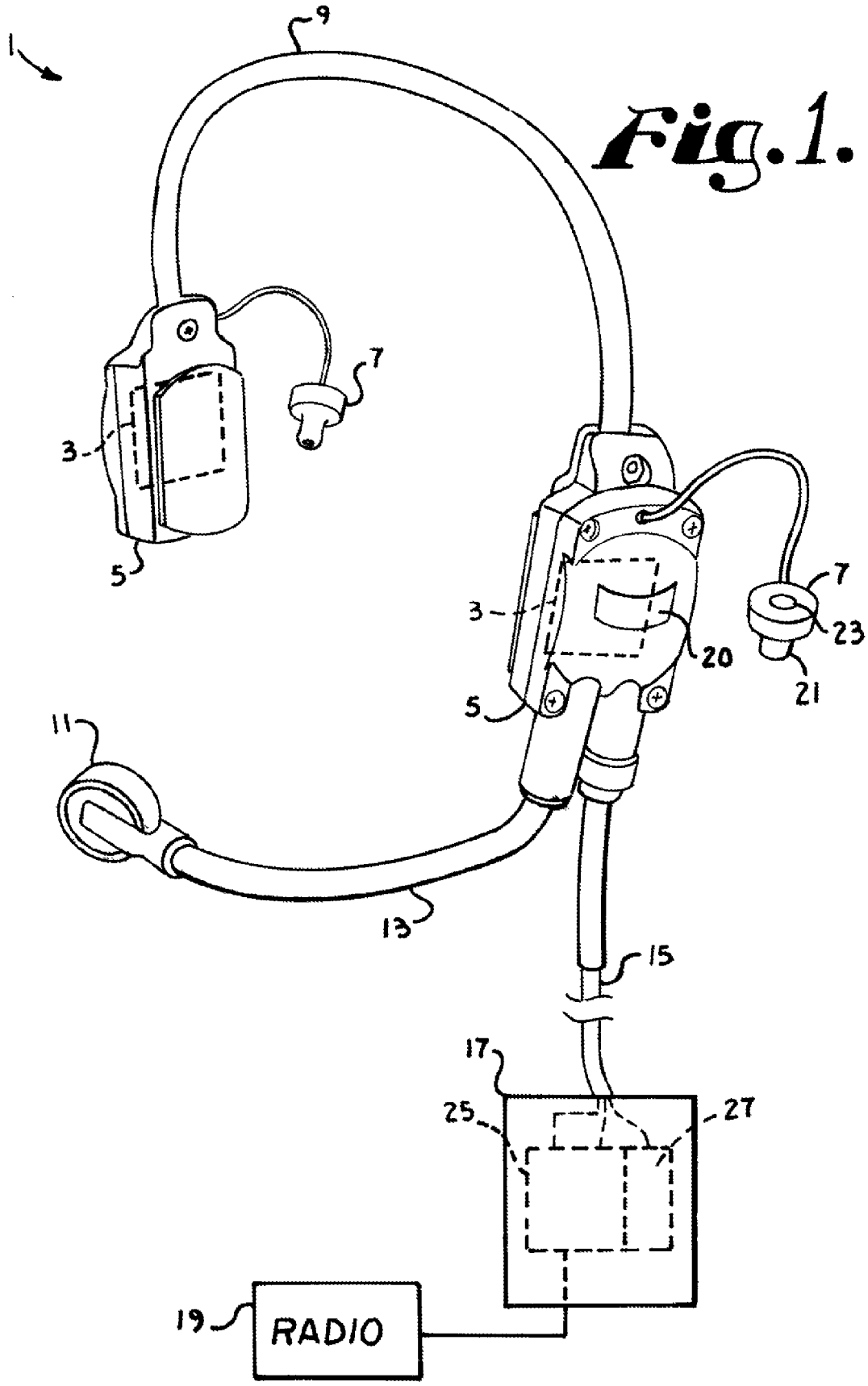
FIG. 1 is a perspective and partially schematic view of a communications headset in combination with a radio and a communications interface.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Figure 2:
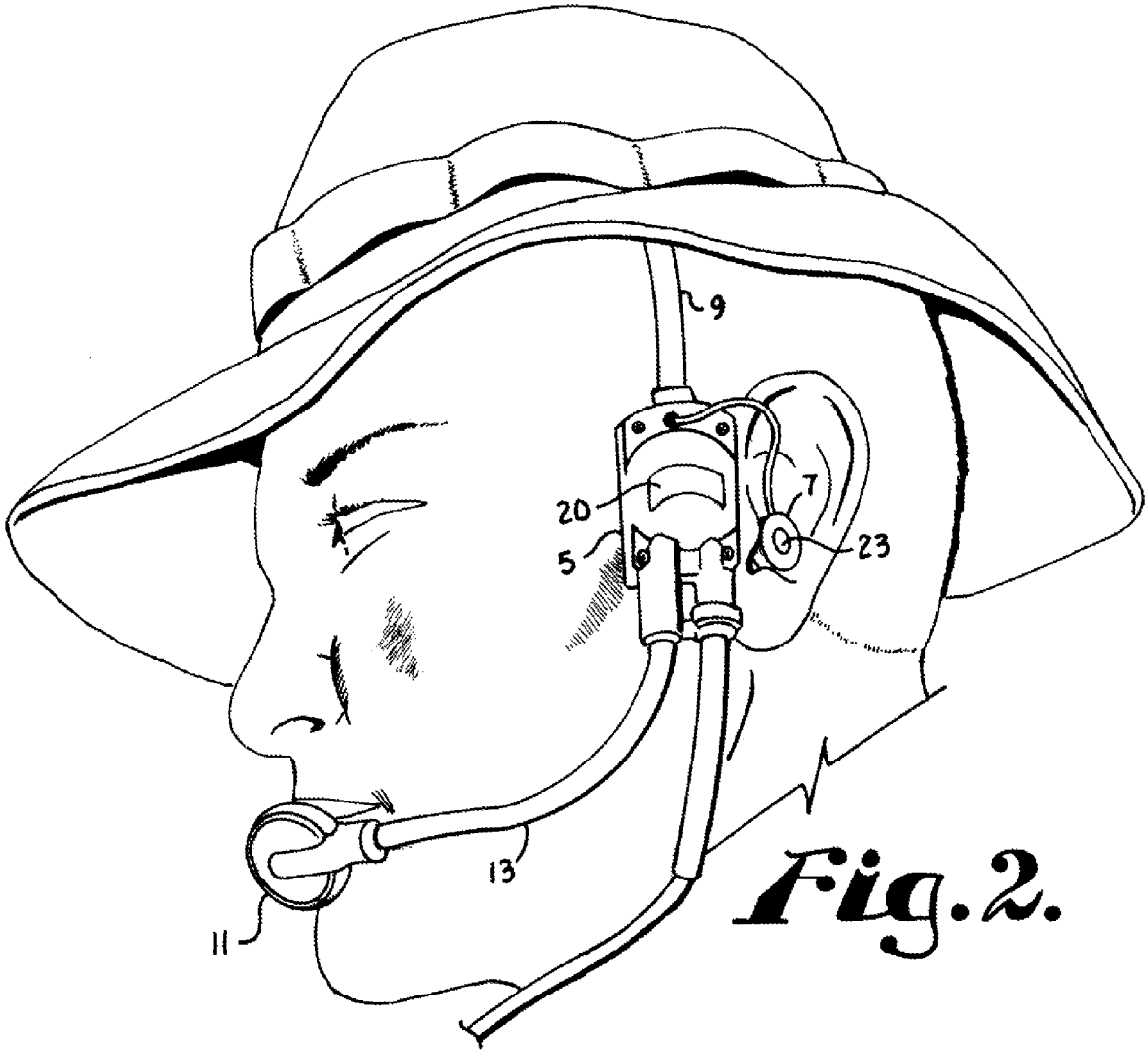
FIG. 2 is a perspective, fragmentary and partially schematic view of a communications headset on a wearer's head showing an earpiece for the communications headset positioned in the wearer's ear.
Figure 3:
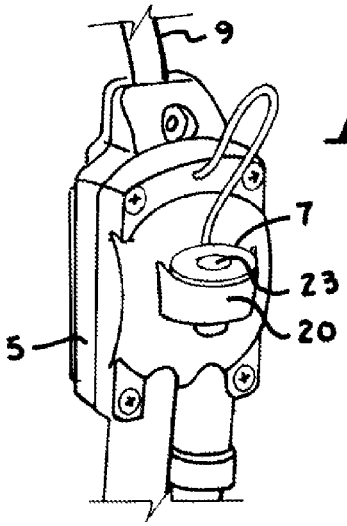
FIG. 3 is a perspective and fragmentary view of the communications headset showing the earpiece holstered in a holster on the body of the communications headset.
Figure 5:
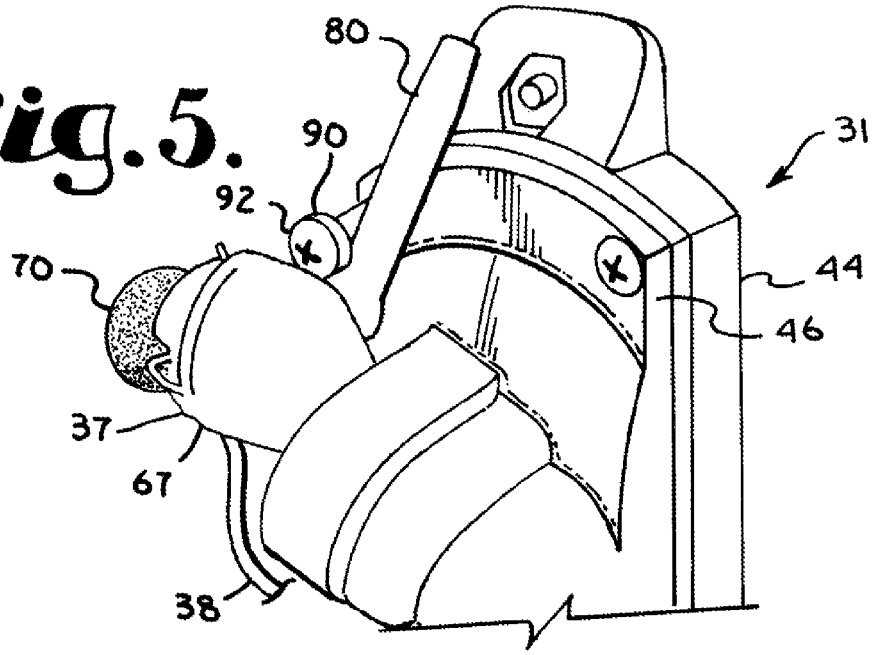
FIG. 5 is an enlarged and fragmentary, right side perspective view of a housing of the communications headset as shown in FIG. 4 showing the earpiece secured in a holster thereon.

Referring to the drawings in more detail, the reference number 1 generally designates a communications headset incorporating a pair of bone vibrating transducers 3 mounted in housings 5 for distributing received radio signals as sound waves through a wearer's temporal bones or other cranial bones to the inner ear or auditory system in simultaneous combination with a pair of earpieces 7 for distributing received radio signals as sound waves through a wearer's auditory canal to the auditory system. It is foreseen that the earpieces 7 could also be ear plugs and not function to transmit sound through the wearer's auditory canal. In the embodiment shown in FIGS. 1-3 in which the earpieces 7 do transmit sound waves, the earpieces are connected to the respective transducer housing 5 by a wire or conductor 8. Sound waves are transmitted through the wires 8 which also function to tether the earpieces to the respective transducer housing 5.

Although not limited to a single configuration, the transducer housings 5 may be mounted on a frame, strap or other head gear 9 for supporting the housings 5 against the temporal bones of a wearer in front of the ears. A microphone 11 mounted on a boom arm 13 is connected to one of the transducer housings 5. A communications link or cable 15 connects the transducer housing 5 with the attached microphone 11 to a communications interface 17 which may be mounted on the body of a wearer and changed between transmit and receive modes with any of a variety of switches. The interface 17 is then wired or otherwise linked to a radio 19 which may be worn in various locations on the user's body or mounted within various types of vehicles.

Each transducer 3 is wired to the communications interface 17 as is each earpiece 7. The earpieces 7 are wired through the associated transducer housing 5. A holster-like storage compartment 20 is mounted on each transducer housing 5 such that the associated earpiece 3 may be stored in the holster 20 when not in use. The earpieces may be disconnected and replaced by the user. Removal of the earpieces will not affect the headset's ability to receive or transmit radio communications through the bone vibrating transducers, the boom microphone and their associated circuitry.

The earpieces, when properly inserted in the ear canals, will provide the wearer with a certain level of passive hearing protection. Each earpiece 7 includes a speaker portion 21 and one or more microphones 23. The speaker portion 21 is directed inwardly toward the wearer's ear canal and serves two purposes: a) to deliver incoming communications received from the radio or any other external audio source, and b) to deliver sounds from the wearer's ambient environment to the ear canal. Ambient or environmental sounds are detected by the microphone(s) 23 that face outwardly, and are then electronically processed and distributed to the speakers.

The interface 17 includes a housing 24 with an internally mounted transducer circuit board 25 for processing signals from the radio 19 to the transducers 3 and from the headset microphone 11 back to the radio 19. Additionally, the interface 17 includes a second internally mounted earpiece circuit board 27 for processing incoming radio signals and distributing them to the earpiece speaker portions 21 through the wires 8, and for processing sounds detected by the earpiece microphone(s) 23 and distributing those processed sounds back to the earpiece speaker portions 21. Processing may include attenuating or reducing loud external sounds to protect the wearer's hearing. This processing may include the use of ANR or Active Noise Reduction circuitry. For example, the earpieces 7 may be used to reduce the noise level of gunshots detected by the microphone(s) 23 while simultaneously allowing the wearer to hear radio communications through the speaker portions 21. Processing may also include amplifying the wearer's ambient environment while simultaneously providing the wearer with adequate situational and directional awareness. The transducer circuit board 25 is linked to the earpiece circuit board 27 to deliver radio signals or other external audio signals from the transducer circuit board 25 to the earpiece circuit board 27.

Figure 7:
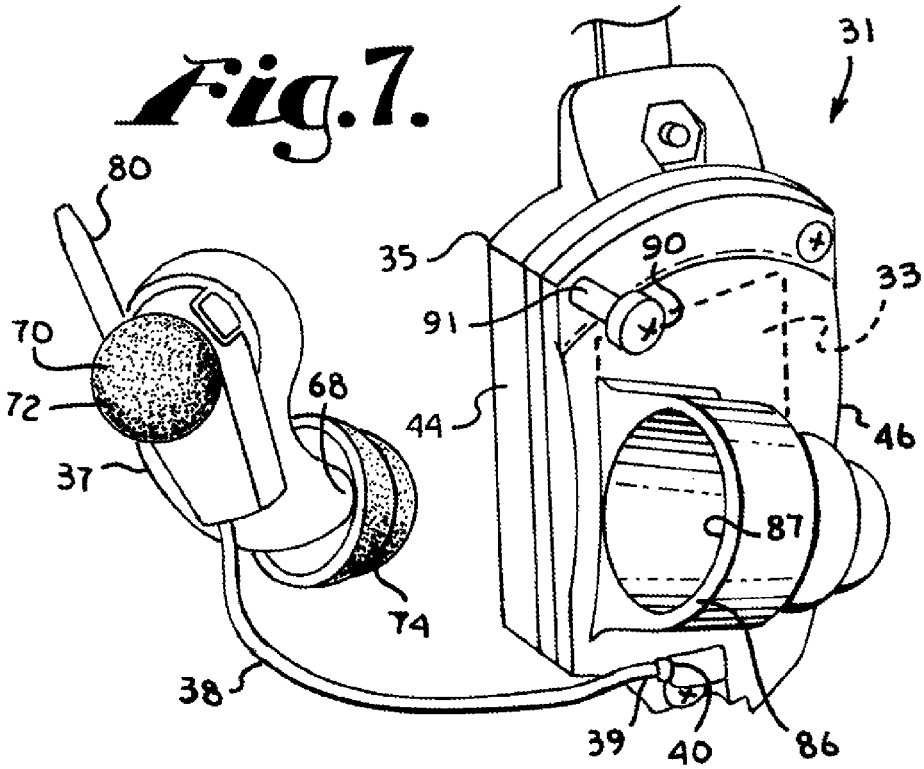
FIG. 7 is an enlarged and fragmentary, left side perspective view of the communications headset housing showing the earpiece separated therefrom.
Figure 8:
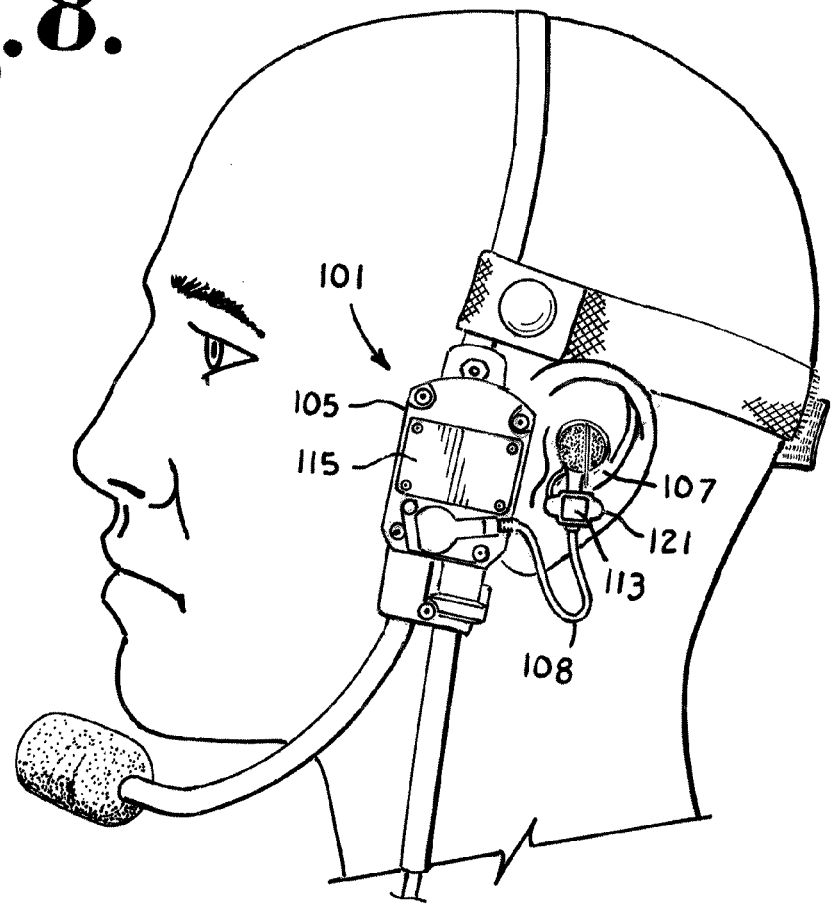
FIG. 8 is a fragmentary side view of a second alternative embodiment of the communications headset shown secured to the head of a wearer with an earpiece positioned in the wearer's ear.
Figure 9:
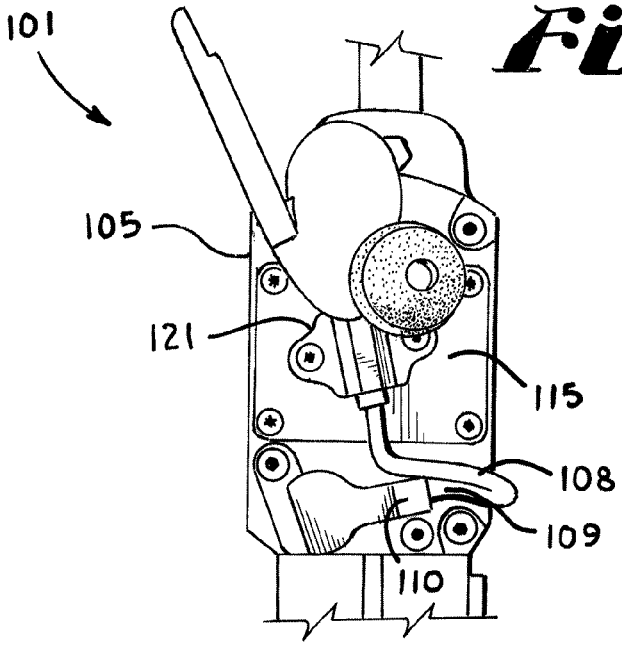
FIG. 9 is an enlarged and fragmentary, front, elevational view of a housing for a bone vibrating transducer of the communications headset as shown in FIG. 8 showing the earpiece magnetically coupled thereto.

Referring to FIGS. 4-7 there is shown an alternative embodiment of a bone vibrating transducer headset 31 incorporating bone vibrating transducers 33 mounted in housings 35 for distributing received radio signals as sound waves through a wearer's temporal bones or other cranial bones to the inner ear or auditory system in simultaneous combination with a pair of earpieces 37 for distributing received radio signals as sound waves through a wearer's auditory canal to the auditory system. Only one headset 31 and earpiece 37 is shown in FIGS. 4-7. A second headset 31 with earpiece 37, not shown, is mounted on the opposite side of the wearer's head. As best seen in FIG. 7, each earpiece 37 is connected to the respective transducer housing 35 by a wire or conductor 38 which has a plug end 39 which is removably connectable to a socket 40 formed in the housing 35. Sound waves are transmitted through the wire 38 which also functions to tether the earpiece 37 to the respective transducer housing 5. As with the first embodiment described above, it is foreseen that the earpieces 37 could also be ear plugs and not function to transmit sound through the wearer's auditory canal.

The transducer housings 35 may be mounted on a frame, strap or other head gear 42 for supporting the housings 35 against the temporal bones of a wearer in front of the ears. The transducer housings 35 are generally formed from a base 44 and a cover plate 46 that is bolted onto the base 44. The base 44 and cover plate 46 are preferably molded with thirty three percent glass filled nylon comprising an appropriate material of construction. The transducer 33 is positioned within a cavity formed in the base 44 and covered by the cover plate 46. A sealing layer or gasket (not shown) may be formed between the base 44 and the cover plate 46. A layer of foam padding (not shown) is preferably adhered to the surface of the base 44 to be positioned against a wearer's face for comfort.

As with the first embodiment, a microphone 51 mounted on a boom arm 53 is connected to one of the transducer housings 35. A communications link or cable 55 connects the transducer housing 35 with the attached microphone 51 to a communications interface (not shown in FIGS. 4-7) which may be mounted on the body of a wearer and changed between transmit and receive modes with any of a variety of switches. The interface may be of the type shown in FIG. 1 as communications interface 17 which is wired or otherwise linked to a radio 19 which may be worn in various locations on the user's body or mounted within various types of vehicles. Each transducer 33 is wired to the communications interface 17 as is each earpiece 37. As noted above, a plug end 39 of the wire 38 for each earpiece 37 may be inserted in a socket 40 formed in the housing 35 which is in turn electrically connected to the communications interface 17. The earpieces 37 may be disconnected and replaced by the user. Removal of the earpieces 37 will not affect the headset's ability to receive or transmit radio communications through the bone vibrating transducers 33, the boom microphone 51 and their associated circuitry.

Each earpiece 37, includes an earpiece body 67 with a speaker portion 68 and one or more microphones 70 connected thereto or mounted thereon. The speaker portion 68 is directed inwardly toward the wearer's ear canal and serves two purposes: a) to deliver incoming communications received from the radio or any other external audio source, and b) to deliver sounds from the wearer's ambient environment to the ear canal. Ambient or environmental sounds are detected by the microphone 70 that face outwardly, and are then electronically processed and distributed to the speakers.

A foam wind cover 72 is secured around the microphone 70 to reduce noise from wind. A resilient tip or ear bud 74 is secured around the speaker portion 68 to more securely hold the earpiece 37 in a wearer's ear, particularly while the wearer is moving around in field conditions. In the embodiment shown the resilient tip 74 is formed from a flexible silicone material with two hemispherical flanges or barbs 76 projecting outward from a central bore 78 through which sound is transmitted to the auditory canal of the wearer.

A flexible concha bow 80 is mounted on and projects outward from the earpiece body 67 between the microphone 70 and the speaker portion 68. The concha bow 80 generally extends transverse to the speaker portion 68. The concha bow 80 is formed from a flexible plastic and is generally tubular in shape and sized for insertion into the concha which is the largest and deepest cavity in the wearer's ear. Referring to FIG. 4, the concha bow 80 (shown in phantom lines) engages the flap of skin extending adjacent the concha of the wearer's ear to further secure the earpiece 67 in place therein.

An earpiece holster 85 is mounted on or formed on the cover plate 46 of each transducer housing 35 such that the associated earpiece 37 may be stored in or secured to the holster 85 when not in use. The holster 85 is preferably integrally molded into the cover plate 46 forming a holster sheath or wall 86 which surrounds and defines a holster cavity 87. The holster cavity preferably opens rearwardly and slightly upward relative to the housing 35 as positioned on the head of a wearer. An axis through the cavity and out the opening to the cavity generally extends upward at an angle of roughly thirty degrees relative to horizontal when the headset 31 is worn. The holster wall 86 and the holster cavity 87 taper inward from the rear opening to the cavity toward the front of the transducer housing 35. In the embodiment shown, the holster wall 86 incorporates a stepped configuration with each step of reduced diameter.

The holster cavity 87 is sized and shaped to frictionally or snugly receive the resilient tip 74 of the associated earpiece 37 to removably secure or hold the earpiece 37 in the holster 85. A concha bow stop 90 projecting outward from the housing cover plate 46 cooperates with the concha bow 46 to resist removal of the earpiece 37 from the holster 85. In the embodiment shown, the concha bow stop 90 projects outward from the upper left corner of the housing cover plate 46. The stop 90 generally comprises a screw hub or spacer 91 through which a screw 92 used to secure the cover plate 46 to the base 44 is threaded. The stop 90 is spaced slightly behind an upper, rear edge of the holster wall 86.

When the resilient tip 74 of the earpiece speaker 68 is secured in the holster cavity 87, the concha bow 80 generally extends just behind a rear edge of the holster wall 86. The earpiece 37 may be rotated slightly to rotate the concha bow 80 toward the head of the wearer to advance the concha bow 80 in front of or on the forward side the concha bow stop 90 relative to the head of the wearer. Abutment of the concha bow 80 against the concha bow stop 90 prevents the earpiece 37 from moving or sliding rearwards and out of the holster 85. The earpiece 37 is removed from the holster 85 by first rotating the earpiece slightly to pivot the concha bow out of overlapping relationship with the concha bow stop 90 and then pulling the earpiece 37 rearward pulling resilient tip 74 out of the holster cavity 87.

The communications interface used in association with headset 31 may be of similar construction as interface 17 of the headset embodiment shown in FIG. 1 which includes a housing 24 with an internally mounted transducer circuit board 25 for processing signals from a radio such as radio 19 to the transducers 33 and from the headset microphone 51 back to the radio 19. The interface 17 also includes a second internally mounted circuit board or earpiece circuit board 27 for processing incoming radio signals and distributing them to the earpiece speaker portions 68 through the wires 38, and for processing sounds detected by the earpiece microphone or microphones 70 and distributing those processed sounds back to the earpiece speaker portions 68. Processing may include attenuating or reducing loud external sounds to protect the wearer's hearing. This processing may include the use of ANR or Active Noise Reduction circuitry as discussed previously. Wiring, not shown, extending through the headgear 42, connects the transducer 33 and earpiece 37 to which the microphone 51 and interface cable 95 are attached, to the opposite transducer 33 and earpiece 37.

An alternative embodiment of the communications headset 101 is shown in FIGS. 8 through 11 and also includes a pair of bone vibrating transducers 103 mounted in housings 105 for distributing received radio signals as sound waves through a wearer's temporal bones or other cranial bones to the inner ear or auditory system in simultaneous combination with a pair of earpieces 107 for distributing received radio signals as sound waves through a wearer's auditory canal to the auditory system. Only one transducer housing 105 and earpiece 107 are shown in FIGS. 8-11. A second transducer housing 105 and earpiece are mounted on the opposite side of the wearer's head. The earpieces 107 are magnetically couplable to the transducer housings 105 as discussed in more detail hereafter to facilitate relatively quick securement of the earpieces 107 to the housings 105 when removed from the wearer's ear.

Each earpiece 107, which may be constructed similar to earpieces 37, is tethered to a respective housing 105 by a wire or conductor 108 which has a plug end 109 which is removably connectable to a socket 110 formed in the housing 105. Sound waves are transmitted through the wire 108. As with the first embodiment described above, it is foreseen that the earpieces 107 could also be ear plugs and not function to transmit sound through the wearer's auditory canal.

Each earpiece 107 is releasably coupled to the transducer housing 105 to which it is tethered by a magnet 113 acting on a ferromagnetic plate or section of ferromagnetic material 115. In the embodiment shown, the ferromagnetic plate 115 is secured to an outer surface 117 of the housing 105 and the magnet 113 is coupled to or closely associated with the earpiece 107. The plate 115 may be securely fastened to housing 105 by bolts, and adhesive or other securement means known in the art. It is also foreseen that the plate 115 could be secured on an inner surface of the housing or that the housing itself could be formed from a ferromagnetic material to permit coupling of the magnet 113 thereto.

It is also foreseen that the ferromagnetic plate could be associated with the earpiece 107 and the magnet 113 with the transducer housing. However, the transducer 103 utilizes magnets to operate and mounting the magnet 113 on the housing 105 without additional shielding between the magnet 113 and the transducer 103 may result in interference with the operation of the transducer 103. Therefore, in the preferred embodiment the plate 115 is mounted on the housing and formed thick enough to provide shielding of the transducer 103 from the magnetic field of magnet 113 coupled to plate 115.

As best seen in FIGS. 10 and 11, earpiece 107 may be constructed similar to earpiece 37 including a body 127, a speaker portion 128 projecting from one end thereof and a microphone 130 also projecting from the body 127. A foam wind cover 132 preferably covers the microphone 130 and resilient ear bud 134 covers the speaker portion 128. The conductor 108 projects from the earpiece body 127 at an end generally opposite the speaker portion 128. In the embodiment shown, the magnet 113 is adhered to a magnet mounting assembly 121 that is clamped onto and around the conductor 108 in close proximity to the earpiece body 107 and more specifically adjacent the portion of the earpiece body 107 from which the conductor 108 projects such that little or none of the conductor 108 is visible between the magnet mounting assembly 121 and the base of the earpiece body 127.

The magnet mounting assembly 121 comprises first and second clamp plates 136 and 137 which are bolted together around the conductor 108. As shown in FIG. 10, the magnet mounting assembly 121 may be clamped around a flexible cord guard 140 extend secured around the conductor 108. A sufficient length of the conductor 108 extends from the magnet mounting assembly 121 to the socket 110 in the housing 105 to permit the conductor or tether 108 to fold back over itself to permit coupling of the magnet 113 associated with the earpiece 107 to the plate 115 on the housing 105. In the embodiment shown, the magnet mounting assembly 121 is positioned adjacent to or in closely spaced relation to the body 127 of the earpiece 107.

It is foreseen that the magnet may be mounted directly on the body 127 of the earpiece 107 or inside of the body 127. However, mounting the magnet 113 adjacent the earpiece 107 reduces interference between the magnet 113 and the speaker 128 or microphone 130. In the embodiment shown the magnet 113 is formed as a square plate 143 of ferromagnetic material that has been magnetized to function as a permanent magnet. The plate 143 in the embodiment shown is smaller than the plate 115 on the housing 105.

In the embodiment shown, the magnetic plate 143 is glued or adhered to the clamp plate 136 and the clamp plates 136 and 137 are clamped around the conductor 108 so that the clamp plate 136 and magnet 113 face in a direction opposite from the direction that the speaker portion 128 extends from the earpiece 107. When the speaker portion 128 is in a wearer's ear, the magnetic plate 143 will face outward. Similarly, the ferromagnetic plate 115 on the transducer housing 105 faces outward and is generally positioned just forward of the wearer's ear. When the wearer wants to remove and secure the earpiece 107, the wearer simply grasps the earpiece body 127 with two fingers, pulls the earpiece 107 from the ear and flips the earpiece over and toward the transducer housing 105 so that the magnet 113 faces and is positioned in close proximity to the ferromagnetic plate 115 on the transducer housing 105 so that the magnetic force from the magnet 113 will pull the magnet 113 and the associated earpiece 107 toward the ferromagnetic plate 115 on the transducer housing 105 and magnetically couple the earpiece 107, through the magnet mounting assembly 121, to the transducer housing 105. The magnet 113 is sufficiently strong to hold the earpiece 107 to the housing 105, but not too strong to prevent manual removal of the earpiece 107 from the housing 105.

As shown in FIGS. 10 and 11, a strand of monofilament 145, such as a nylon monofilament or the like may be secured at opposite ends to the earpiece body 27, projecting outward therefrom and over the microphone windscreen 132 to provide additional structure, generally in the form of a loop, for a wearer to grasp to facilitate removal of the earpiece 107 from the wearer's ear. The nylon monofilament 145 is provides minimal acoustic interference to the microphone. The magnetic mounting assembly also provides structure that is convenient for the wearer to grasp to remove the earpiece 107

It is to be understood that while certain forms of the present invention have been illustrated and described herein, it is not to be limited to the specific forms or arrangement of parts described and shown. For example, it is foreseen that the communications headset could utilize a single bone vibrating transducer mounted on one side of the wearer's head and correspondingly a single earpiece. It is also foreseen that the magnet 113 and ferromagnetic plate 115 could be replaced by other manually releasable coupling means such as mating sections of a hook and loop type fastener or a releasable adhesive.

As used in the claims, identification of an element with an indefinite article "a" or "an" or the phrase "at least one" is intended to cover any device assembly including one or more of the elements at issue. Similarly, references to first and second elements is not intended to limit the claims to such assemblies including only two of the elements, but rather is intended to cover two or more of the elements at issue. Only where limiting language such as "a single" or "only one" with reference to an element, is the language intended to be limited to one of the elements specified, or any other similarly limited number of elements.

What is claimed is:

1. A communications assembly including:

a) a bone vibrating transducer secured within a housing;

b) an earpiece tethered to said housing for said bone vibrating transducer;

c) a first manually releasable coupling member mounted on said housing; and d) a second manually releasable coupling member associated with said earpiece, such that said earpiece is manually releasably couplable to said housing by coupling said first manually releasable coupling member to said second manually releasable coupling member.

2. The communications assembly as in claim 1 wherein said first manually releasable coupling member is a first of a magnet or a section of ferromagnetic material and the second manually releasable coupling member is a second of the magnet or the section of ferromagnetic material.

3. The communications assembly as in claim 1 wherein said first manually releaseable coupling member is mounted on an outer surface of said housing.

4. The communications assembly as in claim 1 wherein said earpiece is removably tethered to said housing by a conductor.

5. The communications assembly as in claim 4 wherein said second manually releasable coupling member comprises a magnet mounted on a magnet mounting assembly secured around said conductor.

6. The communications assembly as in claim 4 wherein said second manually releasable coupling member comprises a magnet mounted on a magnet mounting assembly secured around said conductor in closely spaced relation to a body of said earpiece.

7. The communications assembly as in claim 4 wherein said second manually releasable coupling member comprises a magnet mounted on a magnet mounting assembly secured around a cord protector extending around said conductor.

8. A communications headset including:

a) a bone vibrating transducer secured within a housing;

b) a headgear connected to said housing for supporting said housing against a face of a wearer proximate an ear;

c) an earpiece tethered to said housing for said bone vibrating transducer of said communications headset by a conductor, said earpiece including a resilient tip for insertion in a wearer's auditory canal; and d) a first manually releasable coupling member mounted on said housing;

e) a second manually releasable coupling member associated with said earpiece such that said earpiece is manually releasably couplable to said housing by coupling said first manually releasable coupling member to said second manually releasable coupling member.

9. The communications headset as in claim 8 wherein said first manually releasable coupling member is a first of a magnet or a section of ferromagnetic material and the second manually releasable coupling member is a second of the magnet or the section of ferromagnetic material.

10. The communications headset as in claim 8 wherein said first manually releaseable coupling member is mounted on an outer surface of said housing.

11. The communications headset as in claim 8 wherein said second manually releasable coupling member comprises a magnet mounted on a magnet mounting assembly secured around said conductor.

12. The communications headset as in claim 8 wherein said second manually releasable coupling member comprises a magnet mounted on a magnet mounting assembly secured around said conductor in closely spaced relation to a body of said earpiece.

13. The communications headset as in claim 8 wherein said second manually releasable coupling member comprises a magnet mounted on a magnet mounting assembly secured around a cord protector extending around said conductor.

14. A communications headset including:

a) a bone vibrating transducer secured within a housing;

b) a headgear connected to said housing for supporting said housing against a face of a wearer proximate an ear;

c) an earpiece tethered to said housing for said bone vibrating transducer by a conductor;

d) a magnet associated with said earpiece; and e) a section of ferromagnetic material associated with said housing, wherein said magnet is magnetically couplable with said section of ferromagnetic material to releasably couple said earpiece to said housing.

15. The communication headset as in claim 14 wherein said section of ferromagnetic material is mounted on an outer surface of said housing.

16. The communications headset as in claim 14 wherein said magnet is mounted on a magnet mounting assembly secured around said conductor.

17. The communications headset as in claim 14 wherein said magnet is mounted on a magnet mounting assembly secured around said conductor in closely spaced relation to a body of said earpiece.

18. The communications headset as in claim 14 wherein said magnet is mounted on a magnet mounting assembly secured around a cord protector extending around said conductor.

* * * * *